United States Patent [19]

McNerney

[11] 4,387,750

[45] Jun. 14, 1983

[54] SEWER CLEAN OUT DEVICE

[76] Inventor: Robert McNerney, P.O. Box 166, Sharpsville, Pa. 16150

[21] Appl. No.: 313,968

[22] Filed: Oct. 22, 1981

[51] Int. Cl.[3] ..... B65B 3/04

[52] U.S. Cl. ..... 141/331; 141/363

[58] Field of Search ..... 141/331–345, 141/363–366, 311 R

[56] References Cited

U.S. PATENT DOCUMENTS 2,189,238 2/1940 Benjamin ..... 141/363

2,752,067 6/1956 Kohl et al. ..... 141/363

*Primary Examiner*—Houston S. Bell, Jr

*Attorney, Agent, or Firm*—Harpman & Harpman

[57] ABSTRACT

A sewer clean out device comprising a tank in direct connection with the sewer which holds and releases a high volume of aqueous solution into the sewer to keep the sewer line clean and open, and thus prevent a clogged sewer line. The tank has valve release to maintain a head of aqueous solution within the tank for later release.

5 Claims, 3 Drawing Figures

SEWER CLEAN OUT DEVICE

BACKGROUND OF THE INVENTION (1) Field of the Invention

This invention relates to devices that are used to clean out and maintain a sewer line by the rapid flushing of a high volume of aqueous solution.

(2) Description of the Prior Art

Prior art devices of this type can be seen in U.S. Pat. No. 3,661,261 and in U.S. Pat. No. 838,963.

In U.S. Pat. No. 3,661,261, a sewer flushing device is disclosed having a tank connected to the sewer in which a quantity of sewage is introduced and held by a vacuum means to be released periodically to maintain the flow in the sewer.

U.S. Pat. No. 838,963 discloses an automatic sprinkler system which includes a tank and a valve shown in FIG. 1 of the drawings for activating the sprinklers connected thereto.

SUMMARY OF THE INVENTION

A sewer line clean out device for producing a large flow of aqueous solution directly into the sewer line from a tank above the level of the sewer. The tank is fitted into a clean out opening of the sewer line with a controlled release valve to maintain the aqueous solution within the tank until release.

DESCRIPTION OF THE PREFERRED EMBODIMENT

Figure 1:
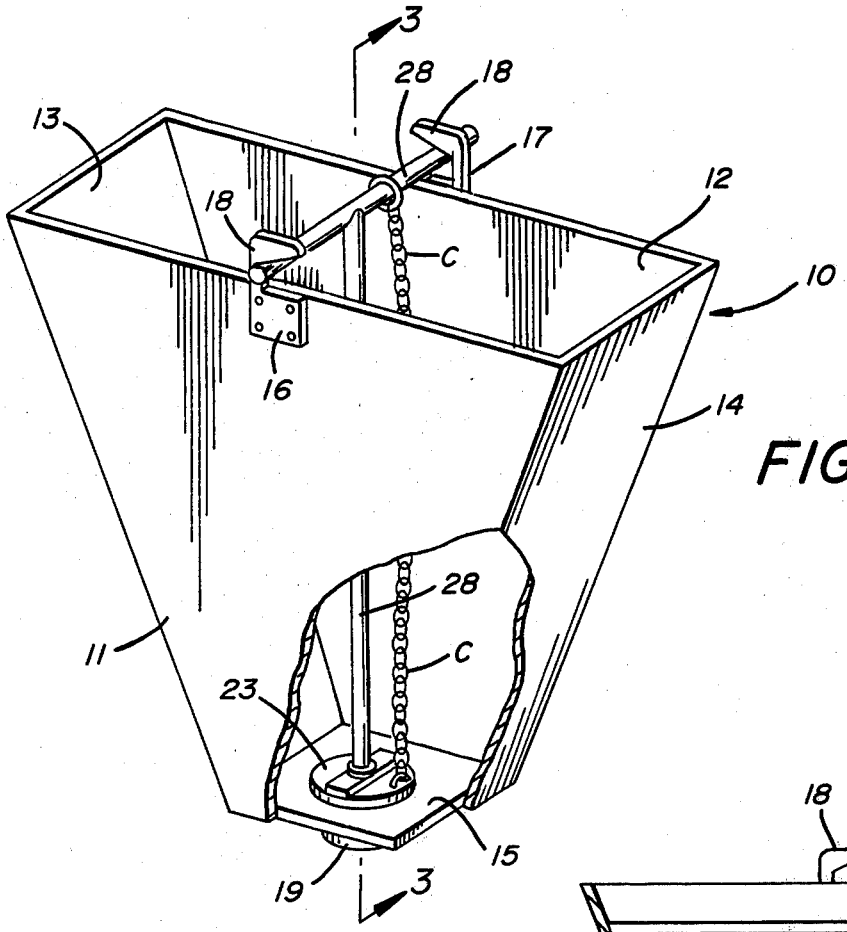
FIG. 1 is a perspective view of the sewer clean out device with parts broken away.

A sewer clean out device comprising a storage tank 10 having front and back walls 11 and 12 and end walls 13 and 14. The end walls 13 and 14 are tapered inwardly towards one another to a bottom plate 15. The front and back walls 12 and 13 extend vertically from the bottom plate 15 and form with the end walls a generally rectangular tapered configuration with an open top larger than that of the bottom plate 15.

A pair of oppositely disposed retainer brackets 16 and 17 are attached to the front and back walls 12 and 13 respectively midway between the end walls 13 and 14. Each of the retainer brackets 16 and 17 comprises a rectangular body member, the upper portion being cutaway to form a tapered member 18 extending above the device. A sleeve 19 is secured in and extends through an aperture in the bottom plate 15 forming an opening 20 in the horizontal plane of the bottom plate 15.

Figure 2:
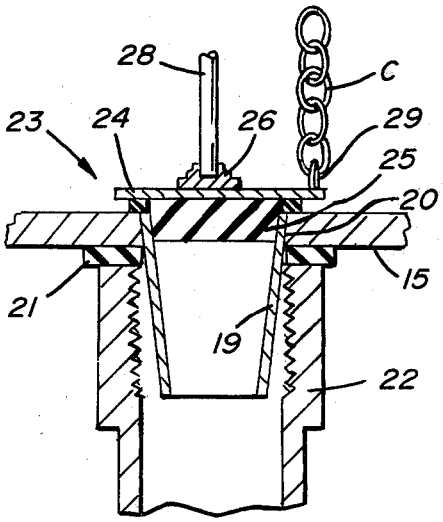
FIG. 2 is a cross sectional view of a valve portion of the device.

An annular gasket 21 of non-porous material is positioned around the downwardly extending portion of the sleeve 19 against the bottom of the plate 15 to form a seal between the sleeve 19 and a sewer pipe opening 22 best seen in FIG. 2 of the drawings.

A valve stopper 23 comprises a disc 24 of a resilient material having a thick rubber body 25 secured to one side adjacent the opening, a socket 26 is secured to the other side. The rubber body 25 has an annular non-porous gasekt 27 secured to the disc 24 around the rubber body 25. The non-porous gasket 27 extends downwardly so that it engages the bottom plate 15 and the sleeve 19 forming a water tight seal therebetween.

The socket 26 removably holds a T-shaped bar 28 whose vertical portion extends up above the top of the tank 10. The T-bar 28 engages the tapered members 18 locking the rubber body 25 in place against the opening 20 as best seen in FIG. 1 of the drawings. The disc 24 is distorted as is the rubber body 25 by the tension created when the T-bar is engaged in the tapered members.

Figure 3:
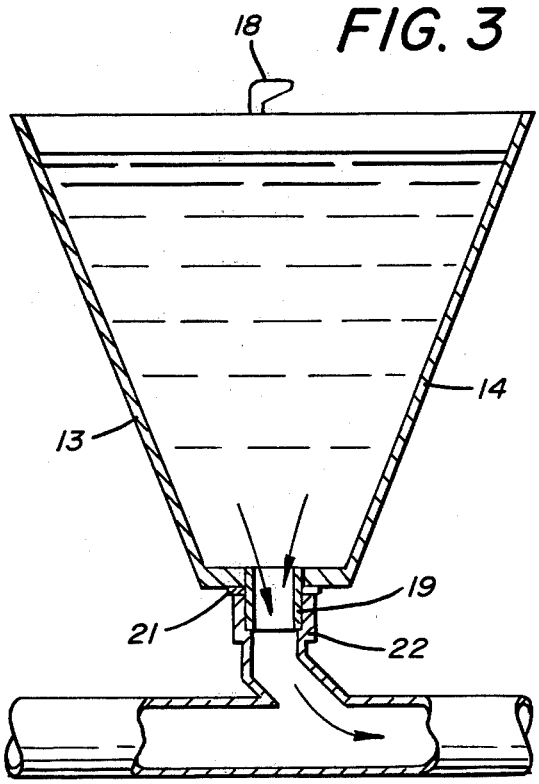
FIG. 3 is a section on lines 3—3 of FIG. 1 showing the device connected to a sewer line.

An eyelet 29 on the disc 24 has a length of chain C extending therefrom to a ring 30 on the horizontal portion of the T-bar 28 so that when the T-bar 28 is removed, the valve stopper 23 can be pulled up releasing the aqueous solution from within the storage tank 10 through the sleeve 19 into the sewer opening 22. The rapid release of aqueous solution from the storage tank 10 as seen in FIG. 3 of the drawings producing a liquid surge and pressure equal to that of the volume of the storage tank, rate of flow and height of the tank above the sewer opening 22.

During operation, various chemicals can also be added to the aqueous solution within the storage tank 10 to aid in the clean up process and to help dissolve foreign matter not fully flushed by the force of the solution as it passes through the sewer pipe.

In a typical application, the sewer clean out device would hold twenty gallons of water to which would be added one gallon of bleach (sodium hypochlorite) and up to three pounds of salt per gallon of water.

Frequency of use will depend on the individual situation. Thus it will be seen that a new and useful sewer clean out device has been illustrated and described and it will be apparent to those skilled in the art that various changes and modifications may be made herein without departing from the spirit of the invention.

What I claim is:

1. A clean out device for communication with a sewer pipe opening in a sewer line comprising a storage tank, a sleeve in communication with said storage tank and said sewer pipe opening, said sleeve having an inner diameter equal to that of said sewer line so that a large volume of liquid inside said tank can flow through said sleeve, a valve stopper engaging said sleeve, said valve stopper formed of resilient material, a rubber body secured to said valve stopper, means for holding said valve stopper against said sleeve arranged to distort said valve stopper and rubber body, fasteners secured to said storage tank for engagement with said holding means, means for sealing said sleeve in an opening in a sewer line to be cleared, means for moving said valve stopper from said sleeve.

2. The sewer clean out device of claim 1 wherein said tank is of a greater height than width having a bottom and side walls extending upwardly therefrom, said sleeve being in communication with an opening in said bottom end extending therethrough into said tank.

3. The sewer clean out device of claim 1 wherein said means for moving said valve stopper comprises a member attached to the valve stopper and extending upwardly therefrom.

4. The sewer clean out device of claim 1 wherein said storage tank has a bottom, said sleeve communicating with an opening in said bottom, upstanding walls attached to said bottom, at least two of said walls being of a lesser width at their points of attachment to said bottom than at their opposite ends, whereby said tank is of a modified funnel shape.

5. The sewer clean out device of claim 1 wherein said fasteners are members having tapered configurations for detachably engaging said bar and wherein said bar is T-shaped having a vertical section and horizontal section and the fasteners engage said horizontal section of said bar.

* * * * *